United States Patent [19]

Thompson

[11] 4,140,462

[45] Feb. 20, 1979

[54] COOLING MEANS FOR MOLTEN METAL ROTARY ATOMIZATION MEANS

[75] Inventor: Charles C. Thompson, Jupiter, Fla.

[73] Assignee: United Technologies Corporation, Hartford, Conn.

[21] Appl. No.: 862,899

[22] Filed: Dec. 21, 1977

[51] Int. Cl.[2] ..... B22F 9/00; B22D 23/08

[52] U.S. Cl. ..... 425/8; 264/8

[58] Field of Search ..... 425/8; 264/8

[56] References Cited

U.S. PATENT DOCUMENTS

| | | | |
|---|---|---|---|
| 2,587,710 | 3/1952 | Downey | 425/8 X |
| 2,897,539 | 8/1959 | McMillan | 425/8 X |

FOREIGN PATENT DOCUMENTS

| | | | |
|---|---|---|---|
| 480496 | 11/1975 | U.S.S.R. | 425/8 |

*Primary Examiner*—Robert L. Spicer, Jr.
*Attorney, Agent, or Firm*—Jack N. McCarthy

[57] ABSTRACT

A rotary liquid metal atomizer is positioned to receive a stream of molten metal on the top thereof. The atomizer is formed as a hollow disc means having a concave top surface and mounted for rotation at high RPM's on the top of a hollow drive shaft. A circular coolant baffle is located in the hollow disc means having radial passageways on the top and bottom thereof and connected at the outer periphery for cooling fluid to flow around, and is mounted on the top of an inlet cooling tube located within the drive shaft. Cooling fluid is directed through the inlet cooling tube to the top of the water baffle wherein it flows through a hole in the center thereof and through the passageways between the baffle and the interior of the hollow disc means and down between the inlet cooling tube and drive shaft. A pin fixes the baffle to the disc means. The top of the disc means over the coolant baffle is formed of copper. A metal rim is placed around the upper outer periphery of the copper disc with a ceramic coating within. A prewhirl tube insert fixed in said inlet cooling tube aids in preventing backflow by rotating the column of water with the inlet cooling tube.

6 Claims, 3 Drawing Figures

FIG. 1
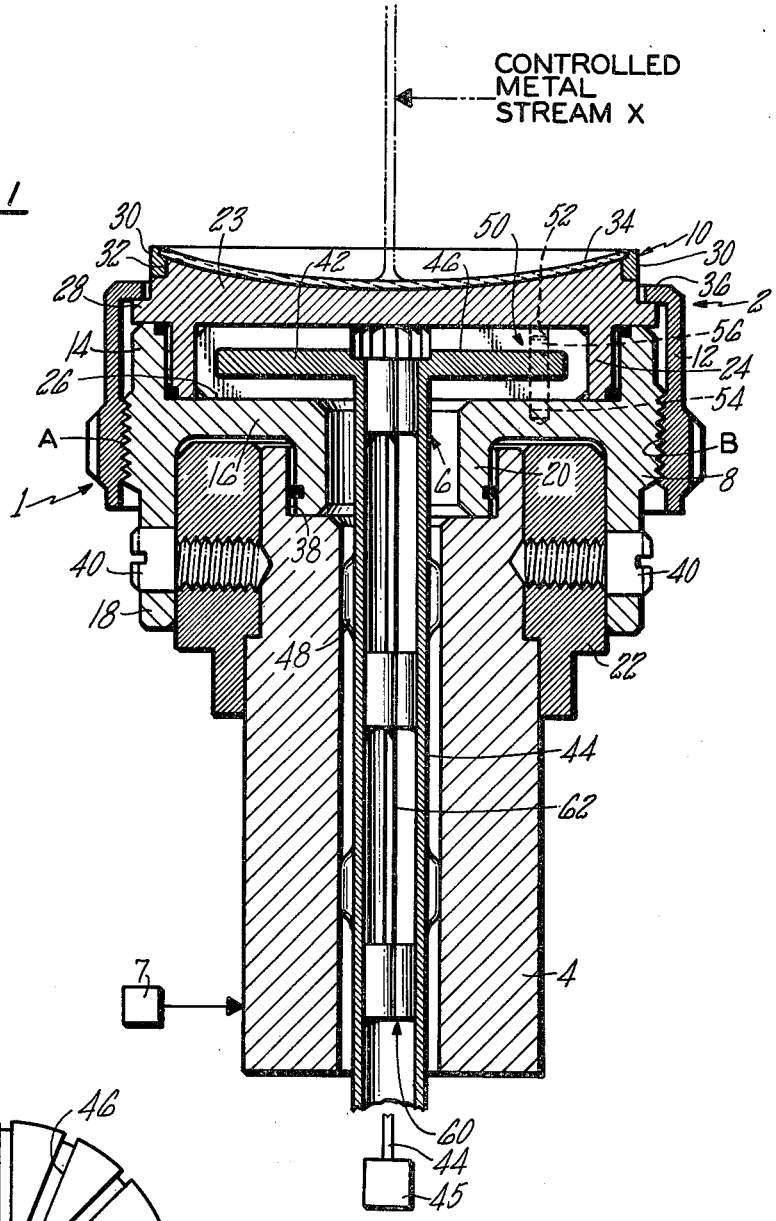
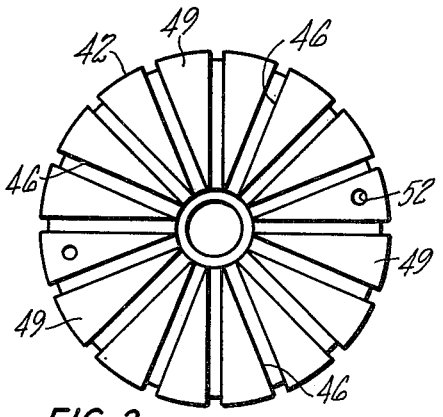
FIG. 2
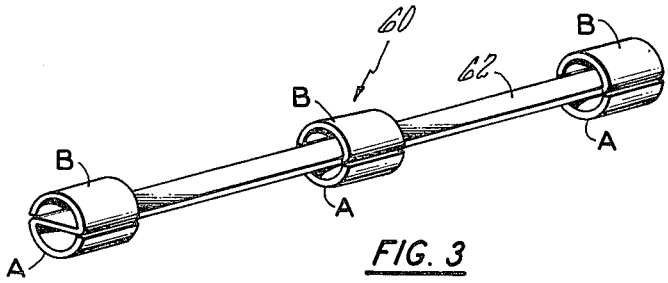
FIG. 3

COOLING MEANS FOR MOLTEN METAL ROTARY ATOMIZATION MEANS

The invention disclosed herein was made in the performance of or under a contract with the Department of Defense.

CROSS-REFERENCE TO RELATED APPLICATIONS

Application Ser. No. 862,897 to Romeo G. Bourdeau for "Spin Cup Means for the Production of Metal Powder" and Application Ser. No. 862,898 to Robert A. Metcalfe et al for "Rotary Atomization Means for the Production of Metal Powder" are being filed herewith and disclose related arrangements.

BACKGROUND OF THE INVENTION

This invention relates to means for cooling a rotary liquid metal atomizer for the production of metal powders. This type of atomizer is designed for the production of rapidly quenched metal powders as shown in U.S. Pat. Nos. 4,025,249 and 4,053,264. A further disclosure of an apparatus for using such a metal atomizer, or disc, is set forth in U.S. Application Ser. No. 654,247 and U.S. application Ser. No. 751,004. Other prior art patents showing various types of cooled rotary atomizing devices are listed below: U.S. Pat. No. 3,721,511; U.S. Pat. Nos. 2,699,576; 4,027,718; and 2,271,264.

SUMMARY OF THE INVENTION

It is an object of this invention to provide a rotary atomization means which is internally cooled by a flowing coolant, said coolant maintaining the atomization means at a temperature below its melting point and aiding in maintaining a desired temperature of the molten liquid metal flowing onto said atomization means.

It is another object of this invention to provide a rotary atomization means having a cylindrical coolant baffle fixedly positioned in a cylindrical space in the atomization means with radial passageways on the top and bottom thereof and connected at the outer periphery; these passageways have a constant flow area to reduce contraction and expansion losses and reduce the tendency for flow separation.

It is a further object of this invention to provide a cylindrical coolant baffle with narrow radial passageways to aid in reducing secondary flow losses. The radial passageways are equally spaced to insure uniform coolant distribution on the under side of the body portion containing the surface onto which the molten metal comes into contact.

It is another object of this invention to provide an elongated baffle in the inlet cooling tube connected to the cylindrical coolant baffle to whirl the flow therein along with the cooling tube. The greatest advantage from this elongated baffle is obtained at very high RPM's of the rotary atomization means.

BRIEF DESCRIPTION OF THE DRAWINGS

FIG. 1 is a sectional view of a cooled liquid metal atomizer attached to the end of a shaft for rotation;

FIG. 2 is a view of the circular baffle of the liquid metal atomizer showing the radial passageways; and FIG. 3 is a view of the pre-whirl tube insert of the inlet coolant tube.

DESCRIPTION OF THE PREFERRED EMBODIMENT

Rotary atomization means 1 are shown for receiving a stream X of molten metal and accelerating it radially outwardly in an apparatus for making metal powder. Such apparatus is referred to above in the listed patents.

While any type crucible can be used having any controlled means for heating and pouring, such a construction is shown in U.S. Pat. No. 4,025,249 wherein a crucible having an induction furnace associated therewith is pivotally mounted in a movable supporting carriage. Such construction can be used for the pouring of the molten metal referred to in this application and induction control means provided to control the temperature of the molten metal.

This atomization means 1 comprises a disc means 2 fixedly mounted to the top of a drive shaft 4. Drive shaft 4 can be mounted for rotation by any means desired and can be rotated by any one of a known number of means 7, such as by an electric motor, or by an air turbine. For this application, RPM's over 10,000 are considered high and over 25,000 are considered very high. Cooling means 6 are provided within said disc means 2 and drive shaft 4. The disc means 2 is formed having a lower body portion 8 and a composite upper body member 10. The composite upper body member 10 is fixed to the lower body portion 8 by a large hold-down nut 12.

The lower body portion 8 is formed having a cylindrical member 14 projecting upwardly from the outer periphery of an annular member 16. A cylindrical member 18 also extends downwardly from the outer periphery of said annular member 16. Another short cylindrical member 20 extends downwardly from the inner edge of the annular member 16. The two downwardly extending cylindrical members 18 and 20 form an annular groove which receives the upper end of the drive shaft 4 and adapter member 22, to be hereinafter described.

The composite upper body member 10 is formed having an upper body portion 23 with a downwardly projecting flange 24 which fits within the inner surface of the cylindrical section 14 of the lower body portion 8. This construction forms a cylindrical space 26 between the upper body portion 23 and the lower body portion 8. A radially extending flange 28 extends outwardly around the outer periphery of the upper body portion 23 with the lower surface thereof contacting the top of the cylindrical section 14 while a shorter top surface is used for a purpose to be hereinafter described.

The top of the upper body portion 23 is formed concave, but could be a flat surface. An outer metal ring member 30 is fixed in a peripheral recess 32 formed around the top of the outer periphery of the upper body portion 23. The top of the ring member 30 extends above the top surface of the upper body portion 23 a distance to accommodate a ceramic coating 34. This specific construction is described in more detail and claimed in Application Ser. No. 862,898 to Robert A. Metcalfe et al, referred to above.

The outer surface of the lower body portion 8 is externally threaded at A to receive the internal threads B of the large hold-down nut 12. The top of the hold-down nut 12 has an inwardly extending annular flange 36 which engages the shorter top surface of the radially extending flange 28 for holding the upper body portion 23 in position against the lower body portion 8. The top of the hollow drive shaft 4 is formed having a recess 38 therein for receiving the downwardly extending short cylindrical section 20. The adapter member 22 is provided to fill the space between the top of the drive shaft 4 and cylindrical member 18. Bolts 40 extend through the cylindrical member 18, adapter member 22 and into the top of the drive shaft 4. This fixes the disc means 2 to the top of the drive shaft 4.

A circular coolant baffle 42 is positioned in the cylindrical space 26 having an inlet coolant tube 44 fixed to the center thereof for delivering a cooling fluid through a central opening which extends through the circular coolant baffle 42. Passageways 46 extend radially outwardly along the bottom of the circular water baffle 42 from the surface of the inlet coolant tube 44 upwardly around the outer periphery of the baffle 42 and inwardly along the upper surface to the edge of the opening at the center thereof. The surfaces 49 between the passageways 46 properly position the coolant baffle 42 in the cylindrical space 26. The coolant baffle 42 is fixed for movement with the disc means 2 by pin means 50; holes 52 can be located in one or more places on said coolant baffle 42 located between adjacent passageways 46 and opening into cooperating surfaces 49 on opposite sides thereof. A matching opening 54 is placed in the surface of annular member 16 forming the bottom of the cylindrical space 26. A pin 56 is placed in aligned holes 52 and 54 and contained therein by the upper body portion 23.

Inlet coolant tube 44 is provided with spacers 48 to properly locate it within the hollow shaft 4. The coolant is pumped upwardly into the inlet coolant tube 44 by a pump 45 around the coolant baffle 42 and down between the inlet coolant tube 44 and cylindrical member 20 and the interior of the hollow drive shaft 4. The cooling fluid maintains the upper body member 10 at a temperature below its melting point and aids in establishing thermal equilibrium for stable operation of the device.

To further aid in coolant flow through the cooling means 6, comprising the inlet coolant tube 44, radial passageways 46 and the outlet coolant passageway between the tube 44 and cylindrical member 20 and the interior of the hollow drive shaft 4, a prewhirl tube insert 60 is located in the inlet coolant tube 44. The pre-whirl tube insert 60 can be an elongated baffle 62 positioned along the length of the inlet coolant tube 44 at its upper end to the point where it enters the passageways 46 of the coolant baffle 42, to whirl the column of water within the inlet coolant tube 44 at the same RPM as the inlet coolant tube 44. The elongated baffle 62 reduces the tendency to backflow at very high RPM's.

The pre-whirl tube insert 60, as shown in FIG. 3, includes an elongated strip which forms an elongated baffle 62. At each end of the pre-whirl tube insert 60, flat portions A and B extend outwardly from each side, each flat portion A and B is curved around to the opposite side of the elongated baffle 62 to form a cylindrical boss which can slideably engage the inner surface of the inlet coolant tube 44. A similar supporting structure can be located midpoint of the ends. When it is necessary to use a pre-whirl tube insert 60, one can be placed in the inlet coolant tube 44 and brazed in place or fixed by any other means desired.

In a modification built, the cylindrical coolant baffle was made with 16 constant area radial passageways 46, where the depth and width was 0.100 inches (0.254 cm). In operation in an apparatus for making metal powder, the coolant used was water.

I claim:

1. A rotary atomization means for receiving a flow of molten metal on an upper surface for the production of solidified metal particles comprising a drive shaft mounted for rotation, disc means fixedly mounted to the top of said drive shaft, said disc means having a lower metal member fixed to the top of said drive shaft, said disc means having an upper metal member fixed to said lower metal member, said lower metal member and said upper metal member having their meeting sides contoured to form a cylindrical space therebetween, said cylindrical space having a cylindrical side wall with a circular top wall and an annular bottom wall, said cylindrical space being coaxial with said drive shaft, elongated opening means extending through the center of said drive shaft and said lower metal member into the opening in said annular bottom wall of said cylindrical space, an annular coolant baffle, said annular coolant baffle having an opening in the center thereof, said annular coolant baffle having an annular top surface and annular bottom surface, said annular coolant baffle having an outer peripheral surface between said annular top surface and said annular bottom surface, a tube connected to said annular coolant baffle around said opening and extending downwardly through the opening in said annular bottom wall of said cylindrical space and said elongated opening means, means centering said inlet coolant tube in said elongated opening means forming an annular outlet passage, said annular coolant baffle having radial passageways in the top and bottom surfaces thereof, said top passageways being aligned with said bottom passageways, axially extending passageways in the outer peripheral surface of said annular coolant baffle connecting the outward radial ends of each pair of said aligned passageways, said cylindrical space having its circular top wall abutting the annular top surface of said annular coolant baffle, said cylindrical space having its annular bottom wall abutting the annular bottom surface of said annular coolant baffle, and the cylindrical outer surface of said cylindrical space contacting the outer peripheral surface of said circular coolant baffle, means fixing said annular coolant baffle to said drive shaft for rotation therewith.

2. A combination as set forth in claim 1 wherein the top and bottom passageways along with the connecting extending passageways in the outer peripheral surface of said annular coolant baffle have a constant flow area to reduce contraction and expansion losses.

3. A combination as set forth in claim 1 wherein the top and bottom passageways along with the connecting extending passageways in the outer peripheral surface of said annular coolant baffle are made narrow to reduce secondary flow losses.

4. A combination as set forth in claim 3 wherein the top and bottom passageways along with the connecting extending passageways in the outer peripheral surface of said annular coolant baffle are made having the narrow width of approximately 0.254 cm.

5. A combination as set forth in claim 1 wherein an elongated baffle is fixed in said inlet coolant tube, the upper end of said elongated baffle being located at the top of said inlet coolant tube so that a column of coolant in said inlet coolant tube is rotating at the same RPM as the annular coolant baffle as it enters the top passageways.

6. A combination as set forth in claim 5 wherein said elongated baffle has cylindrical bosses therearound at several locations, said bosses having contact with the interior of said inlet coolant tube, said bosses being fixed to said inlet coolant tube.

* * * * *